United States Patent [19]

Weiss

[11] 4,038,907

[45] Aug. 2, 1977

[54] STROKE LIMITING MECHANISM WITH FAIL-SAFE FEATURE

[75] Inventor: Adolf F. Weiss, Easton, Pa.

[73] Assignee: Alpha Press Company, Alpha, N.J.

[21] Appl. No.: 650,940

[22] Filed: Jan. 21, 1976

[51] Int. Cl.[2] ..... F15B 13/16; F15B 15/22

[52] U.S. Cl. ..... 91/20; 91/26; 91/361; 91/400; 91/448

[58] Field of Search ..... 91/22, 23, 26, 361, 91/390, 400, 20, 448

[56] References Cited

U.S. PATENT DOCUMENTS

| | | | |
|---|---|---|---|
| 787,136 | 4/1905 | Warren | 91/22 |
| 3,430,538 | 3/1969 | Weiss | 91/361 |

*Primary Examiner*—Paul E. Maslousky

*Attorney, Agent, or Firm*—Roylance, Abrams, Berdo & Kaul

[57] ABSTRACT

A stroke limiting mechanism is connected with the movable member of a hydraulically operated machine to precisely position the movable member. The flow circuit for the stroke limiting mechanism is connected in such a manner that even if an equipment failure occurs, the movable member will be retained in a pressure-balanced condition, thus creating a fail-safe situation.

3 Claims, 4 Drawing Figures

STROKE LIMITING MECHANISM WITH FAIL-SAFE FEATURE

This invention relates to high pressure hydraulically operated machinery, and more particularly, it relates to such machinery including apparatus for controlling the stroke of the movable member in a hydraulic high pressure machine, such as a hydraulic press. Still more particularly, this invention relates to a stroke limiting mechanism for a high pressure hydraulic machine, such as a hydraulic press, with such stroke limiting mechanism including a fail-safe feature to prevent damage to the machine or to parts thereof.

The type of machine with which the invention herein is intended to be used is a high pressure hydraulic press used in compacting operations. Such presses generally include a pair of relatively movable punch members, which, when driven toward one another, tend to compress or compact a powder or slurry material therebetween to form an article of a desired size and shape. The powder or slurry from which the article is formed is introduced into a cavity in a die plate. Opposed upper and lower punch members also fit into the cavity to compress or compact the slurry or powder material therein, thereby forming the article. As is apparent, under such circumstances, the distance by which the upper punch member is separated from the lower punch member, the configuration of the faces of such punch members, and the size of the die opening or cavity serves to determine the configuration of the final article.

While there are many variables which affect the final configuration of the article to be formed, the most critical variable is the stroke adjustment for the movable member in the machine. This adjustment effectively determines the distance between the upper and lower punch members as such members are disposed within the cavity in the die case. This adjustment of relative movement between the upper and lower punch members must be of an extremely high degree of accuracy to be certain that the powder or slurry material in the cavity will be compacted to the proper degree of pressure. Moreover, it is necessary not only to apply the initial pressure in a proper manner, but it is also necessary to maintain such pressure for an adequate length of time to permit the powder or slurry material to set, cure, adhere or otherwise undergo the physical or chemical changes necessary before the article is fully formed. My U.S. Pat. No. 3,430,538, dated Mar. 4, 1969, discloses one satisfactory form of stroke limiting mechanism for use on such a hydraulic press. My U.S. Pat. 3,951,042, discloses another form of stroke control apparatus for such a hydraulic press. The disclosures of both my aforementioned patents should be considered as incorporated by reference herein.

While stroke control apparatus such as that disclosed in my aforementioned patent and application operates most satisfactorily when an operator or attendant is present, there is the possibility that significant machine damage could occur if the machine was left unattended, yet under high pressure, for a considerable period of time. It must be realized that the pressures involved in hydraulic machines of this type are quite high and that the various valves and the like on the machine could develop very slight leakage if left unattended and under high pressure for a considerable period of time. Such leakage, however slight, could then start progressive movement of the machine parts and as such movement occurred, the stroke control mechanism, the dies, the punches and other parts of the machinery could be moved to undesired positions thus creating failure or damage in these parts.

In view of the foregoing, it is a primary object of the present invention to provide some form of fail-safe feature in the stroke limiting mechanism utilized on high pressure hydraulic machinery.

Another object of the present invention is to provide a fail-safe feature in conjunction with stroke limiting mechanism for a hydraulic machine, wherein the fail-safe feature neither impedes operation of nor materially increases the costs of the stroke limiting mechanism.

Other objects, advantages and salient features of the present invention will become apparent from the following detailed description, which, taken in conjunction with the annexed drawings, discloses a preferred embodiment of the invention.

Referring now to the drawings, which form a part of this original disclosure:

Figure 1:
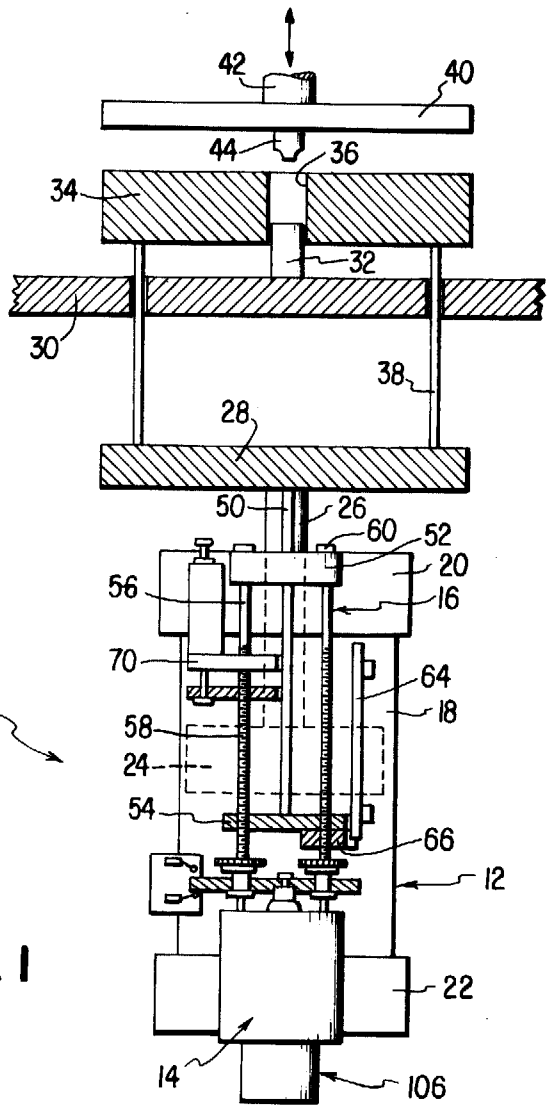
FIG. 1 is a diagrammatic view of the general type of high pressure hydraulic equipment utilized in conjunction with the present invention, showing the stroke control mechanism appended thereto.
Figure 2:
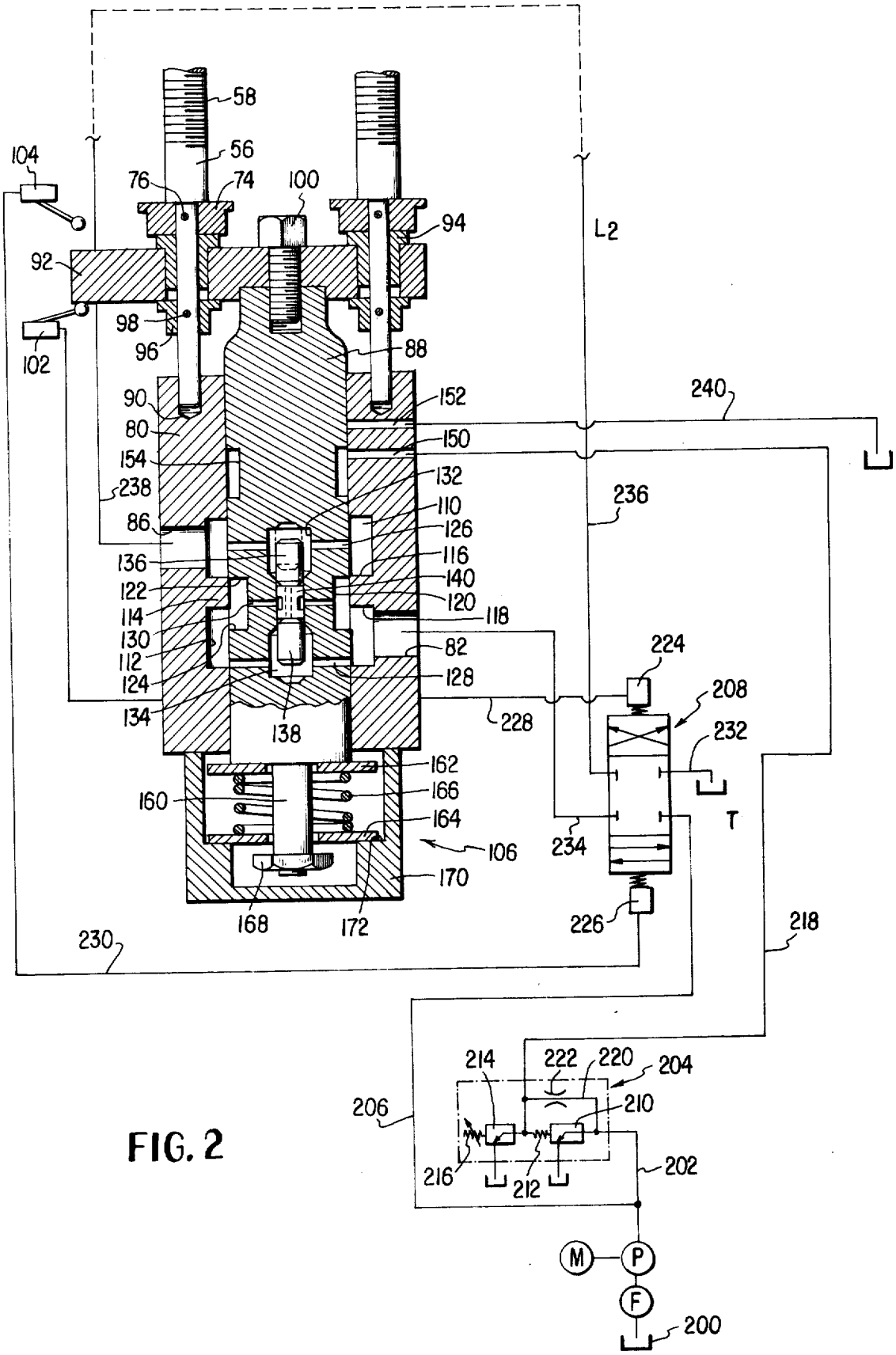
FIG. 2 is a diagrammatic sectional view of the stroke control mechanism and flow circuit of the present invention.

With the exception of the flow circuit, the apparatus shown in FIGS. 1 and 2 is substantially the same as the apparatus shown in my prior U.S. Pat. No. 3,430,538 which is incorporated herein by reference. As such, the apparatus which is generally designated 10 includes hydraulic operating means generally designated 12, a flow control means generally designated 14 and an elongated adjustment means generally designated 16.

The hydraulic operating means 12 includes an enlarged cylinder 18 having a rod end 20 and a blind end 22. An enlarged piston or ram 24 is movably disposed within the cylinder and is connected by a piston rod 26 to a lower platen 28. The lower platen 28 is disposed beneath a stationary press table 30 having a lower tool or punch 32 mounted thereon. A die case or die plate 34 is disposed above the press table and is provided with a cavity 36 axially aligned with the punch 32. Support rods 38 extend through the press table 30 to connect the die case 34 with the lower platen 28. As a result, by proper adjustment of the stroke of the piston 24, it is possible to very accurately control the positioning of the lower punch member 32 within the cavity 36.

An upper platen 40 is movably mounted above the die case by a suitable operating rod 42 and the upper platen 40 carries an upper punch 44 aligned with and adapted to fit within the cavity 36. It is, of course, understood that the powder or slurry material to be compacted is introduced into the cavity 36 and is then compacted between the punch members 32 and 44.

A rod or shaft 50 depends from the lower platen 28, passes through a plate 52 connected to the rod end of the cylinder and has mounted at its lower end a cross plate 54. The elongated adjustment means 16 of the invention includes a pair of elongated rods 56 having screw threads 58 along the major portion thereof and an enlarged head 60 above the plate 52. An elongated runner 64 affixed to the cylinder body 18 functions as a key which fits into a groove along the edge of the cross plate 54 to prevent the same from rotating.

The adjustment means 16 includes stop members mounted on each of the threaded rods 56. The lower stop member 66 has an edge groove which engages with the runner 64 while the upper stop member 70 has an edge groove which surrounds the shaft 50. In this way, the stop members are prevented from rotating during rotation of the threaded rods. As best illustrated in FIG. 2, the lower end of each rod 56 carries a sprocket 74 fixed to the rod by a pin 76. The sprockets are connected by a chain drive or the like to an adjustment means which causes the rod to rotate as the sprockets are rotated.

The flow control means 14 is connected with the hydraulic operating means 10 at the blind end 22 thereof. The flow control means includes a valve body 80 having a first hydraulic port 82 and a second hydraulic port 86. The port 82 is connected with the flow circuit in a manner to be described hereinafter while the port 86 is connected with the interior of the cylinder 18 such that hydraulic fluid flow to and from the blind end of the cylinder 18 must traverse through the valve body 80.

The lower end of the threaded shaft 56 includes a reduced diameter portion disposed within a bore 90 formed in the top of the valve body 80. Actuator means in the form of an enlarged actuator plate 92 is attached to the threaded rods 56 by extending through bushings 94 mounted in holes in the plate 92. A locking element 96 connected by a cross pin 98 locks the actuator plate 92 on the shafts beneath the sprockets 74 carried thereby.

The movable spool type valve member 88 disposed within the valve body 80 is attached to the actuator plate 92 by means of a bolt 100. In the flow control means, a signal generating means in the form of a pair of spaced limit switches 102 and 104 are provided, such limit switches being positioned to be engaged by the actuator plate 92. A biasing means generally designated 106 is positioned at the bottom of the valve housing to urge the spool member upwardly.

Within the valve body 80, a pair of spaced annular flow chambers 110 and 112 are provided in surrounding relation to the valve member 88. The flow chamber 110 communicates with the port 86 while the flow chamber 112 communicates with the port 82. That portion between the flow chambers 110 and 112 defines a land area 114 having a flat shoulder portion 116 defining a boundary of the flow chamber 110 and a similar flat shoulder portion 118 defines a boundary for the flow chamber 112.

The valve member 88 has a reduced diameter portion 120 formed therein and which is set off by an upper shoulder 122 and a lower shoulder 124. The spacing between these shoulders exceeds the axial length of the land portion 114. A first flow passage 126 extends through the valve member 88 and communicates with the valve chamber 110. Another flow passage 128 extends through the valve member and communicates with the flow chamber 112. A central flow or cross-flow passage 130 extends medially and transversly through the reduced diameter portion 120 of the valve member.

A pair of check valve chambers 132 and 134 are provided internally of the valve spool 88. A check valve 136 is disposed within the chamber 132 and another check valve 138 is disposed within the chamber 134. A central check valve core 140 is positioned between the check valve chambers 132 and 134 and is provided with both an axial bore to permit cross flow between the respective check valve chambers and a transverse bore to communicate with the flow passage 130.

A pair of spaced auxiliary ports 150 and 152 extend through the valve body 80 and an annular groove or recess 154 is formed in the valve member 88 adjacent to these ports. This annular groove 154 is set off by an upper shoulder 156 and a lower shoulder 158.

The biasing means 106 includes a shaft portion 160 at the lower end of the valve body 88, such shaft 160 having a threaded end thereon. The shaft 160 passes freely through enlarged apertures in plates 162 and 164 and through a compression spring 166 disposed between such plates. A nut 168 is threaded on the end of the shaft 160 to retain the plates and spring in position. The entire biasing means is housed within a casing 170 coupled to the valve body 80 and having an internal shoulder 172 formed therein.

Figure 4:
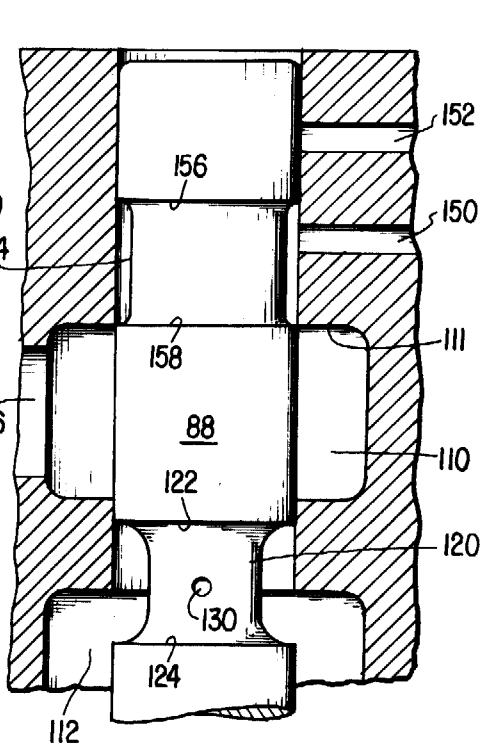
FIG. 4 is a view similar to FIG. 3 but showing the valve member in the down position.
Figure 3:
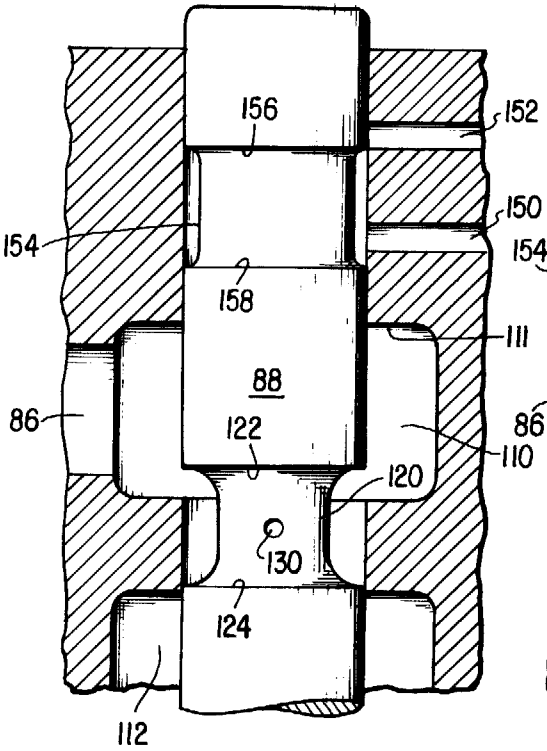
FIG. 3 is an enlarged fragmentary sectional view showing the movable valve member in the up position.

The apparatus thus far described is substantially identical to that disclosed in my aforementioned U.S. Pat. No. 3,430,538. The sole difference, primarily for illustrative purposes, is that the annular groove 154 has been axially elongated somewhat. By now referring to FIGS. 3 and 4, the valve member 88 is shown respectively in its maximum desired upward and downward positions. In FIG. 3, the central flow passage 130 for the check valves is disposed in the flow chamber 110. In FIG. 4, it is disposed in the flow chamber 112. In FIG. 3, the elongated annular groove 154 is situated in communication with the flow port 150, but the upper shoulder 156 normally blocks communication with the flow port 152. It will be noted, however, that the slightest upward movement will elevate the shoulder 156 sufficiently to enable the port 150 to be in flow communication with the port 152, such communication occurring through the annular groove 154. In like fashion, in FIG. 4 it will be noted that the lower shoulder 158 of the annular groove 154 is aligned with the shoulder 111 which forms the top of the flow chamber 110. As such, the slightest additional downward movement of the valve member 88 will place the auxiliary port 150 in flow communication with the flow chamber 110, such communication occurring along the annular groove 154.

To understand the manner in which the apparatus of the subject invention operates in a fail-safe manner, attention is directed to the flow circuit as illustrated in FIG. 2. The parts in such flow circuit have been illustrated generally in accordance with U.S.A. Standard USAS Y 32.10 1967. In the flow circuit, a drive motor M is connected in operational fashion with a pump P which connects through a filter F to a tank or reservoir 200 which contains a supply of hydraulic fluid for the circuit. The pump P is connected by a flow line 202 to a master relief valve generally designated 204. It is also connected by a branch flow line 206 to a solenoid operated valve generally designated 208, the valve 208 serving as the main flow control valve. The main relief valve 204 is a commercially available differential pressure relief valve. It includes a differential pressure responsive valve 210 controlled by a biasing spring 212 and another interconnected valve 214 having a remote adjustable setting 216 which enables the opening pressure for the valve 214 to be selectively adjusted. Both valves 210 and 214 are connectable with a tank or reservoir, as is illustrated. The relief valve 204 is provided with an output line 218 which connects with the auxiliary port 150 of the flow control means. A by-pass line 220 having a flow control orifice 222 therein connects the output line 218 with the flow line 202.

Considering now the flow control valve 208, such valve is a conventional four-way hydraulic valve having a pair of spring biased energizing solenoids 224 and 226 connected therewith. The solenoid 224, which is operational to move the valve 208 to its cross flow position, is connected by an electrical line 228 to the limit switch 102. The solenoid 226, which is operational to permit through flow through the valve, is connected by an electrical line 230 to the limit switch 104. One line 232 from the valve connects with a tank or reservoir T and another line 234 connects from the flow control valve to the port 82 in the valve body 80. Finally, a flow line 236 extends from the flow control valve and connects with the rod end 20 of the main cylinder 18. An output line 238 from the port 86 in the flow control valve is connected to the blind end 22 of the main cylinder 18. Thus, although the lines 236 and 238 are shown in FIG. 2 to be diagrammatically interconnected, it will be understood that these lines effectively are the pressure lines for the main cylinder 18 and they control the pressure on the main piston 24 therein. Thus, if the line 238 provides pressure beneath the main piston 24, thereby raising the piston, the hydraulic fluid will flow out the port in the rod end 20 of the cylinder and through the flow line 236. The alternative is likewise true, namely, if the flow line 236 provides pressure through the rod end 20 of the cylinder and against the top of the piston 24 therein, thus moving the piston downwardly, the hydraulic fluid exhausting from beneath the piston 24 will discharge through the blind end 22 and will pass through the line 238 and the flow control valve 14. Finally, a line 240 is connected from the auxiliary port 152 in the valve body 80 to a tank or reservoir.

As a result of the arrangement of the flow circuit herein, even if there was a failure of one or both of the limit switches 102, 104, or even if the entire main flow control valve 208 were to fail, movement of the ram or piston 24 will nevertheless be stopped and the pressure released. Thus, for example, looking to FIG. 4 and assuming that there has been some type of machine failure, the constant application of pressure may attempt to force the valve member 88 downwardly beyond its maximum down position of FIG. 4. As soon as this would occur, such that the shoulder 158 on the valve member moves beneath the shoulder 111 of the flow cavity 110, the result is that the flow port 150 is placed in flow communication with the flow port 86, such communication occurring through the annular groove 154 and the flow chamber 110. When this occurs, this means that the flow line 218, connected with the port 150, is in flow communication with the flow line 238, connected with the port 86. This means that the pressure applied by the pump P through the line 218 flows directly through the flow control valve and is applied beneath the main ram or piston 24. This necessarily means that the pressure beneath the main ram 24 balances against the weight of the ram and the pressure thereabove, thus placing the ram in balance and preventing any further relative movement of the parts of the apparatus.

As an alternative, if the ram 24 is moving upwardly, and there is some form of failure which would attempt to move the valve member 88 upward beyond its maximum upward position of FIG. 3, the result will be that the upper shoulder 156 will raise above the level of the auxiliary port 152, thereby placing the ports 150 and 152 in flow communication. This means that the pressure applied by the pump P through the flow line 218 will be ported directly back through the flow line 240 to the tank, once again balancing the pressure on the main ram or piston 24.

In other words, it will be understood that when the apparatus of the present invention is functioning in its fail-safe mode, if an undesired downward movement of the ram occurs the system reaches a complete pressure balance. If an undesired upward movement of the ram occurs the system reaches a balance of ram weight versus pressure, then the upward movement ceases.

It will be understood that during normal operation of the apparatus of the subject invention the normal maximum upper position of the valve member 88, as shown in FIG. 3, corresponds with the position where the actuating plate 92 engages and energizes the limit switch 104. Under ordinary operating conditions, the energization of the limit switch 104 effects an energization of the solenoid 226 and a corresponding change in position of the flow control valve 208 from cross flow to through flow thus terminating upward movement of the valve member 88. However, assuming that the limit switch 102 or line 230 was broken, and that the operator was not present to immediately stop the machine, it is then necessary for the apparatus to enter its fail-safe mode of operation. This occurs when the continued upward movement of the valve member 88 raises the shoulder 156 above the level of the port 152, thus placing the ports 150 and 152 in flow communication with each other through the recess 154. This means that the hydraulic pressure delivered by the pump P through the line 218 is returned through the line 240 to the tank so that no further upward movement of the ram 24 or the valve member 88 takes place.

Similarly, under normal operating conditions, the normal maximum lower position, as shown in FIG. 4, corresponds with the position where the actuating plate 92 engages and energizes the limit switch 102. The energization of this limit switch effects an energization of the solenoid 224 and a corresponding change in the flow control valve 208 from through flow to cross flow thus terminating downward movement of the valve member 88. However, assuming that the limit switch 102 or line 228 was broken, and the operator was not present to immediately stop the machine, it is then necessary for the apparatus to enter its fail-safe mode of operation. This occurs when the continued downward movement of the valve member 88 lowers the shoulder 158 beneath the shoulder 111, thus placing the port 150 in flow communication with the port 86 through the recess 154 and flow cavity 110. This means that hydraulic pressure delivered by the pump P through the line 218 is transmitted through the line 238 to be applied beneath the ram 24 so that no further downward movement of the ram 24 or the valve member 88 will occur.

It should be apparent that various changes or modifications obvious to those skilled in the art may be made without departing from the spirit and scope of the invention as defined in the appended claims.

What is claimed is:

1. In a high pressure hydraulic machine which includes a ram movably mounted within a cylinder; hydraulic operating means for effecting movement of said ram; and flow control means for controlling hydraulic flow to and from said hydraulic operating means; said flow control means including a valve body, a valve member movable within said valve body, signal generating means and actuating means connected to and movable with said valve body to actuate said signal generating means; the improvement which enables the aforesaid apparatus to function as a precise stroke limiting means for said movable member while at the same time incorporating a fail-safe mode of operation, which comprises:

said valve body having first and second spaced internal cavities and first and second ports connected respectively therewith;

said valve body additionally having third and fourth ports therein spaced away from said first and second ports;

said valve member having cross-flow passage means extending tranversely therethrough which enables said first and second cavities to be in flow communication with each other;

said valve member also having an elongated annular recess therein disposed at all times in flow communication with said third port, said annular recess being set off between a pair of spaced shoulders which can be defined as an upper shoulder and a lower shoulder;

said valve member being movable within said valve body during normal operation of said machine to reach certain opposed maximum positions which can be defined as a normal maximum upper position and a normal maximum lower position;

said valve member in said normal maximum upper position being disposed with said upper shoulder immediately adjacent to said fourth port but with said annular recess being out of flow communication with said fourth port;

said valve member in said normal maximum lower position being disposed with said lower shoulder being disposed immediately adjacent to said second internal cavity but with said annular recess being out of flow communication with said second internal cavity;

said hydraulic operating means including:

power means for delivering hydraulic fluid from a supply thereof;

first and second flow lines for receiving hydraulic fluid from said power means;

said first flow line being connected to a pressure relief valve and to said third port;

said second flow line being connected through a flow control valve to said first port;

a third flow line connected from said second port to said cylinder to provide hydraulic fluid beneath said ram to effect upward movement thereof;

a fourth flow line connected from said flow control valve to said cylinder to provide hydraulic fluid above said ram to effect downward movement thereof; and a fifth flow line connected from said fourth port to said fluid supply;

said improvement being operative, in the event of a failure wherein said ram moves upward beyond its desired limit, to enter into a fail-safe mode of operation wherein said valve member moves upward beyond its normal maximum upward position, thereby moving said upper shoulder sufficiently to place said annular recess in flow communication with said fourth port whereupon hydraulic fluid being supplied through said first flow line and third port will pass through said annular recess and fourth port and will return to said fluid supply through said fifth flow line;

said improvement being operative, in the event of a failure wherein said ram moves downward beyond its desired limit, to enter into a fail-safe mode of operation wherein said valve member moves downward beyond its normal maximum lower position, thereby moving said lower shoulder sufficiently to place said annular recess in flow communication with said second internal cavity and said second pot whereupon hydraulic fluid being supplied through said first flow line and third port will pass through said annular recess, second internal cavity and second port and through said third flow line to apply upward pressure against said ram.

2. The improvement defined in claim 1 wherein said signal generating means is connected with said flow control valve to control the position thereof.

3. The improvement defined in claim 2 wherein said signal generating means is actuated by said actuating means when said valve member reaches its normal maximum upper position and its normal maximum lower position.

* * * * *